US005216969A

United States Patent [19]

Thomas et al.

[11] Patent Number: 5,216,969

[45] Date of Patent: Jun. 8, 1993

[54] AUTOMATED CARPET BINDING APPARATUS

[75] Inventors: Keith A. Thomas, Woodstock; Michael P. Welsh, Alpharetta; Michael A. Peeples; J. Alan Little, both of Dalton, all of Ga.

[73] Assignee: L & P Products, Inc., Chatsworth, Ga.

[21] Appl. No.: 812,692

[22] Filed: Dec. 23, 1991

[51] Int. Cl.[5] ..... D05B 21/00; D05B 27/00; D05B 35/10; D05B 19/00

[52] U.S. Cl. ..... 112/7; 112/121.15; 112/121.27; 112/309; 112/153; 112/121.11

[58] Field of Search ..... 112/121.26, 121.27, 112/121.11, 308, 309, 160, 121.12, 121.15, 121.29, 153, 7; 271/3.1, 10

[56] References Cited

U.S. PATENT DOCUMENTS

| | | | |
|---|---|---|---|
| 520,909 | 6/1894 | Ames . | |
| 3,722,441 | 3/1973 | Kitchener et al. . | |
| 3,970,017 | 7/1976 | Babson et al. . | |
| 4,181,085 | 1/1980 | Conner, Jr. . | |
| 4,362,115 | 12/1982 | Rose et al. . | |
| 4,434,730 | 3/1984 | Rose et al. . | |
| 4,498,404 | 2/1985 | Sadeh | 112/308 X |
| 4,601,249 | 7/1986 | Frye . | |
| 4,685,408 | 8/1987 | Frye . | |
| 4,688,499 | 8/1987 | Moore et al. . | |
| 4,722,290 | 2/1988 | Manuel et al. . | |
| 4,748,922 | 6/1988 | Bierbaum et al. | 112/121.27 X |
| 4,776,579 | 10/1988 | Romand et al. . | |
| 4,996,931 | 3/1991 | Mall | 112/121.15 X |
| 5,018,462 | 5/1991 | Brocklehurst . | |
| 5,060,924 | 10/1991 | Airaksinen et al. | 112/121.15 X |

*Primary Examiner*—Clifford D. Crowder
*Assistant Examiner*—Paul C. Lewis
*Attorney, Agent, or Firm*—Hopkins & Thomas

[57] ABSTRACT

An edge finishing system for heavily piled, relatively stiff materials has a robot member which engages a piece of the material and forces it to bear against a fence along one edge. The robot moves the piece through a sewing station where tape is applied and sewn to the edge as it is pulled through the station by a splined wheel. A rotating mechanism rotates the piece ninety degrees and the second edge is finished. Where all four edges have been finished, a cutter removes any trailing tape. An automatic hopper moves pieces into position to be gripped and lifted by a gripper mechanism and placed on the work table for the robot to engage the piece.

23 Claims, 3 Drawing Sheets

AUTOMATED CARPET BINDING APPARATUS

FIELD OF THE INVENTION

This invention relates to a piled fabric binding method and apparatus and, more particularly, to such a method and apparatus for producing taped and sewn edges extending continuously along the periphery of a carpet sample.

BACKGROUND OF THE INVENTION

It is customary, in the marketing of carpet, to display samples, usually in the form of, for example, thirty-two inch by thirty-two inch squares contained in a sample "book." In order that fraying of the samples may be minimized and also to present a neat and finished look thereto, it is generally the practice to bind the edges of a sample with cloth tape which is stitched to the edges to make a neat and fray-proof border extending along the entire periphery of the sample.

It is often the case that the individual samples are cut from a carpet roll and the cloth tape is sewn onto the edges by an operator controlled sewing machine, with the operator guiding the sample and feeding the tape onto the edge manually. When one edge of, for example, a rectangular sample is completed, the operator rotates the sample ninety degrees and continues sewing the second edge. This requirement that the sample be rotated at the proper time and to the proper orientation requires a degree of skill and a high degree of concentration on the part of the operator. In a mass production environment, such requirements can be both stressful and tiring, leading to error and consequent wastage. The edging procedure continues until all four edges of the sample have been trimmed with the tape, whereupon the operator cuts the supply tape, staples or sews any dangling end of the tape to the sample, and removes the sample from the machine. Because the carpet material is usually fairly heavy and stiff, the entire process can be quite tiring for the operator in addition to being slow and, of course, labor intensive.

The prior art is replete with machines and apparatus for automating the process of trimming and binding the edges of fabric pieces. For example, there is shown in U.S. Pat. No. 5,018,462 of Brocklehurst an apparatus for finishing the edges of flat soft textile products, such as wash cloths and the like. The Brocklehurst apparatus comprises a transport plate which bears against the cloth piece being edged and moves it into a sewing machine in response to a first sensor being covered. As the trailing edge of the piece passes over and uncovers a second sensor or detector, the transport plate rotates thereby rotating the workpiece through, for example, an angle of ninety degrees, thus covering the first and second sensors, and the workpiece is advanced by the plate until the second sensor is again uncovered. The Brocklehurst arrangement cuts an edge in the material and immediately thereafter stitches the cut edge around the periphery of the workpiece.

Other prior art arrangements utilize sensors to detect when to rotate the workpiece, such as shown in U.S. Pat. No. 4,722,290 of Manuel et al., which has the sensors placed on the sewing machine, U.S. Pat. No. 4,688,499 of Moore et al. which trims the edge of the workpiece prior to sewing an edging tape thereon, and rotates the equivalent of a transport plate to rotate the workpiece, sensors being used to ascertain and control the correct alignment of the workpiece; and U.S. Pat. No. 3,970,017 of Babson et al., which trims the material prior to edging, and utilizes pneumo-electric sensors to govern the operation. The workpiece is turned by means of a work swinging finger which moves in an arcuate slot. Other prior art patents which utilize sensors of one form or another to start, rotate the workpiece for sewing around the corner, and to stop the machines are U.S. Pat. Nos. 4,685,408 of Frye, 4,776,579 of Romand, and 4,601,249 of Frye. All of the aforementioned patents disclose apparatus for edging soft materials such as towels, wash cloths, and the like, which are relatively thin and flexible. The Moore et al. patent treats of throw rugs and other piled materials, which are similar to towels and the like in their softness and flexibility.

The problems concomitant with edging relatively heavy, stiff, and heavily piled materials are not addressed in the foregoing prior art patents, and the arrangements they disclose will not, for a number of reasons, overcome these problems.

A carpet sample which has been cut from a roll of carpet, for example, is characterized by a relatively stiff backing and a heavy pile. Quite often the pile will overlap the backing at the edges of the sample, so that the use of detectors to detect the edge of the sample will often result in the detection of the edge of the pile resulting in a false reading, and the sewing operation will, where edging tape is used, stitch the tape to the pile and not the backing, thus producing an edge that is impermanent and easily pulled apart. Because the carpet samples are individual pieces and not cut from a supply roll adjacent the machine, as shown in the Brocklehurst and Moore et al. patents, for example, unless they are to be conveyed to the machine on a long conveyor, they must be stacked in a bin or hopper at the input end of the machine. The problem then becomes one of removing a carpet from the hopper and placing it on the bed of the machine. The topmost sample cannot simply be slid off of the next lower one because of the heavy pile's resistance to such movement, thus it becomes necessary to lift the sample out of the hopper and place it on the machine bed. The prior art references do not deal with these problems, nor do they disclose any apparatus that might readily be adapted to the solution thereof.

SUMMARY OF THE INVENTION

The present invention, in a preferred embodiment thereof, comprises an edge finishing system for finishing the edges of a relatively stiff, heavy, piled carpet sample, wherein the individual carpet samples are removed from a storage hopper on to the bed or work table of an edge finishing machine which performs the finishing operation without operator intrusion. The system includes a control module or mini-computer and apparatus for removing the sample from the hopper comprising a pair of gripper members which, under control of the programmed control module, grasp the carpet, lift it up from the hopper, and move it forward onto the machine bed. A three axis (X, Y, Z) robot member having a sample engaging plate on its lower surface moves into position over the sample and then is lowered to engage the top surface of the sample with the plate.

After engagement, the robot moves the sample laterally (Y-axis) to force the first sample edge to be finished against a fence which extends along a portion of the length of the machine (X-axis). When the edge is firmly pressed against the fence so that the pile edge and the backing edge are coincident, a sensor detects the condition and robot lateral movement ceases after which robot movement longitudinally (X-axis) commences thereby moving the sample longitudinally with its edge continuing to bear against the fence. A sensor in the work table is adapted to sense the leading edge of the sample and to signal the control module to start the sewing machine, which extends through an opening in the fence and over the area through which the sample edge passes. An adjunct of the sewing machine is a splined rotatable wheel which is adapted to engage the carpet edge, pressing it down and pulling it past the needle of the sewing machine to insure uniformity of stitching. Edging tape, contained on a tape supply reel, is passed through a tape folder in an opening in the fence adjacent the sewing machine needle, where it is folded about the sample edge just prior to being stitched thereto. Because the sample bears firmly against the fence, the tape will be folded over the pile and under the sample backing, thereby insuring a firmly stitched edging to the sample.

Sensor means located in the bed of the work table is adapted to sense the trailing edge of the sample and signal the control module to disengage the robot by lifting it (Z-axis) and moving it upstream (-X-axis) and to disengage the splined wheel. A pneumatically driven rotation clamp located downstream from the splined wheel is adapted to engage the top surface of the sample and to move along an arcuate slot in the work bed in response to the trailing edge sensor signal to the control module and subsequent activation signal from the module, thereby rotating the sample ninety degrees in a counter clockwise direction while the sewing machine stops or continues to operate at a reduced speed After rotation of the sample, during which the corner of the sample is taped and sewn, the robot is lowered until the plate engages the sample and then moves the sample forward while the sewing machine resumes normal speed. This operational routine continues until all edges of the sample have been trimmed, and as the sample progresses beyond the sewing machine, the tape is cut by a scissor blade located between the sewing machine and the rotation clamp. The robot continues to move the sample until it is clear of the sewing, cutting, and rotating mechanism, where it can then be removed from the machine by hand, or deposited in a "finished" hopper.

During the operation of the machine as described in the foregoing, and after the sample has been removed from the hopper, the support plate of the storage hopper indexes up one sample thickness to place the next sample in position to be removed from the hopper and on to the bed of the machine, thereby insuring continuous operation.

The apparatus and sequence of operation thereof of the present invention, as described, is adapted for sewing or binding the edges of carpet samples in a continuous, expeditious manner, with only minimal involvement of the operator. The features and advantages of the invention will be readily apparent from the following detailed description, read in conjunction with the accompanying drawings.

DETAILED DESCRIPTION

Figure 1:
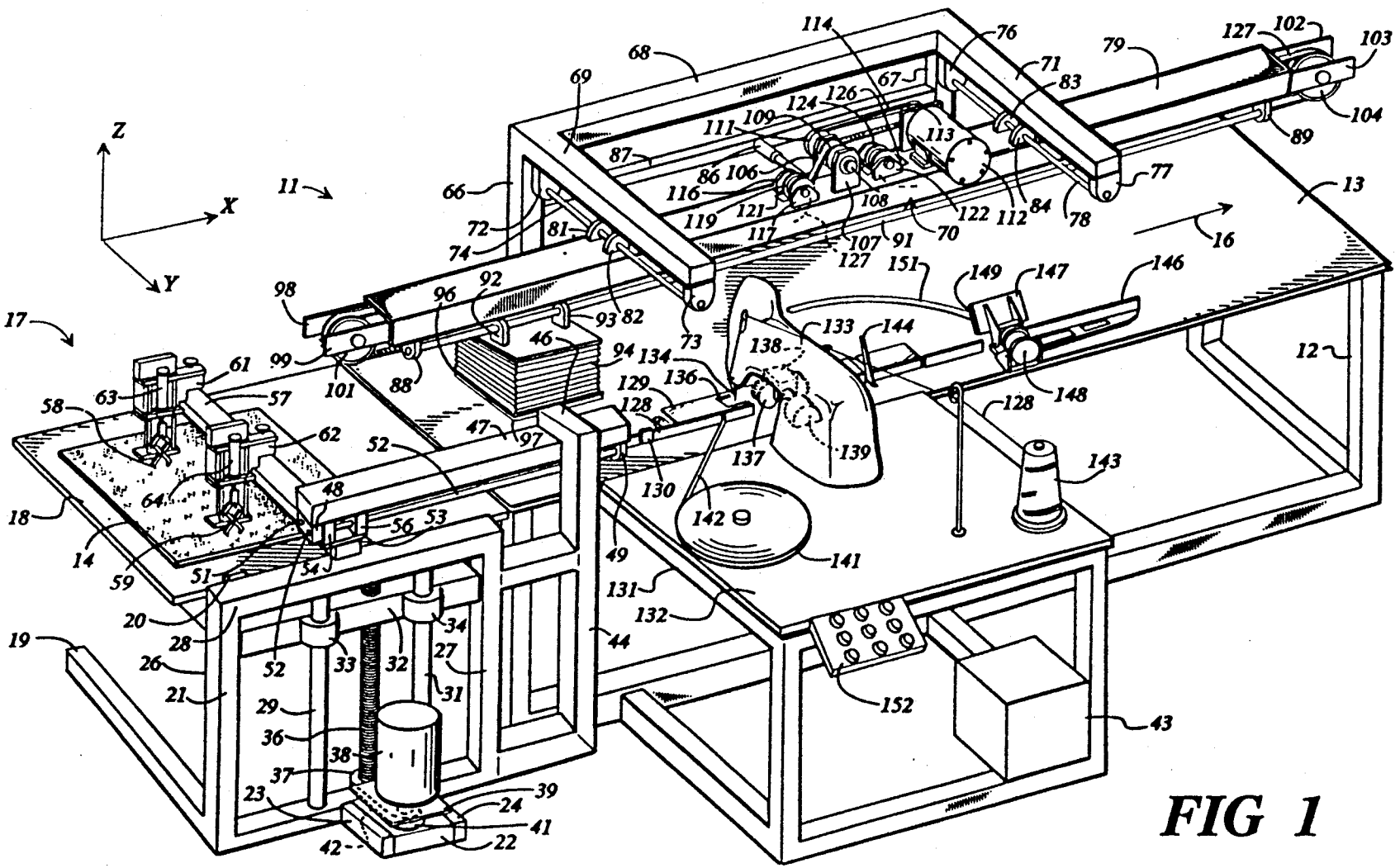
FIG. 1 is a perspective view of a preferred embodiment of the edge finishing apparatus of the present invention.

FIG. 1 depicts the apparatus 11 of the present invention which comprises a frame member 12 having mounted thereon in a substantially horizontal plane a work table or bed 13. Throughout the ensuing description, reference will be made to upstream and downstream, based upon the direction of movement of a carpet sample 14 through the stations of the apparatus, as indicated by the arrow 16. In addition, reference will be made to the orthogonal axes X, Y, and Z, whose orientations are as shown.

Adjacent the upstream end of table 13 is a storage hopper 17 for holding a plurality of carpet samples stacked upon a support platform 18. Hopper 17 comprises a frame member 19 having an upright open portion 21 into which extends a floor plate 22 which extends between legs 23 and 24, and is affixed thereto as by welding. Open portion 21 comprises first and second vertical members 26 and 27, joined at their top ends by a cross member 28. First and second spaced bearing shafts 29 and 31 extend between floor plate 22 and cross piece 28, and are affixed thereto. One end 32 of support plate 18 has a pair of spaced bushing members 33 and 34, adapted to slide freely on shafts 29 and 31 respectively, and has a threaded hole adapted to receive a jack screw 36 which passes therethrough. Jack screw 36 extends between cross piece 28 and floor piece 22, and is rotatably mounted to both. At the lower end of screw 36 is fixedly mounted a pulley 37. A drive motor 38 is mounted on a plate 39 extending between legs 23 and 24, and spaced from plate 22, which drives a drive pulley 41 which, in turn, drives a V-belt 42 and the pulley 37, thereby turning jack screw 36 and raising or lowering platform 18. A detector means 20 is positioned to detect when a carpet sample is in position to be removed from the stack or platform 18. As will be apparent hereinafter, motor 38 is under the control of a programmed control unit 43 which receives signals from detector 20, but, for simplicity and clarity, the connections therebetween have not been shown.

The hopper assembly 17 has mounted thereto an upwardly extending support post 44 having a horizontally extending arm 46 at its upper end. Arm 46 has affixed thereto a longitudinally extending tubular member 47, having at its ends support blocks 48 and 49 which depend therefrom, and which support first and second spaced bearing rods 51 and 52 extending between them. A U-shaped carrier member 53 having journaled legs 54 and 56 is adapted to slide freely on rods 51 and 52, and supports a cross arm 57 extending across a greater portion of the width of the hopper. Carrier member 53 is adapted to be driven along rods 51 and 52 under the control of control module 43 by suitable drive means, which will be discussed more fully hereinafter. Mounted on arm 57 are first and second grippers 58 and 59, spaced apart a distance less than the width of the carpet samples carried in the hopper. The spacing of grippers 58 and 59 is adjustable by means of mounting members 61 and 62 which are adapted to be moved along arm 57 to a desired position and then fixed in place, as by set screws or the like. Grippers 58 and 59 are pneumatically controlled through pistons 63 and 64 respectively, which, in turn, are controlled by control module 43, the connections to which, for clarity, are not shown.

The hopper assembly 17 as described, is preferably welded or bolted to frame member 12, and, as pointed out, is under the operational control of programmed control module 43. As is readily apparent, hopper assembly 17 is adaptable to other uses than that shown here, especially where the stacking of relatively heavy, stiff, piled materials is involved.

Figure 4:
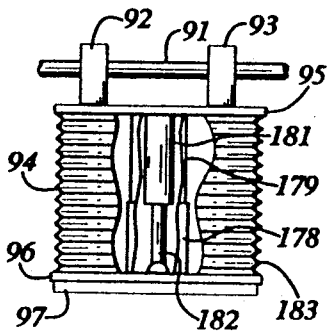
FIG. 4 is a partial cutaway elevation view of the sample engaging apparatus.

At the rear of frame 12 are a pair of spaced, upstanding posts 66 and 67, joined at their top ends by a horizontal member 68, and support first and second transverse arms 69 and 71, forming a subframe for supporting a robot assembly 70. Arm 69 has first and second support members 72 and 73 at either end thereof for supporting a bearing rod 74 extending therebetween, and arm 71, in like manner, has supports 76 and 77 for supporting bearing rod 78. A hollow elongated member 79 is supported from rods 74 and 78 by means of spaced bushing members 81, 82 and 83, 84, and is adapted to slide along rods 74 and 78 in the Y-axis direction. Actuating means for moving member 79 in the Y-direction comprises pneumatic piston and cylinder member 86, attached at one end to member 79 and at the other end to cross-brace member 87. Member 86, as will be apparent hereinafter, operates under the control of control module 43 to move member 79 transversely across the bed or work table 13. Adjacent one end of member 79 are a pair of spaced bushing members 88, 88 only one of which is shown, and adjacent the other end of member 79 is a second pair of spaced bushing members 89, 89, only one of which is shown. Extending between members 88 and 89 is a pair of spaced bearing rods 91, 91, only one of which is visible in FIG. 1. Suspended from rods 91, 91 by means of bushing members 92, 92, and 93, 93, and slidably movable therealong is a robot member 94, which is shown in greater detail in FIG. 4, having at its lower end a sample engaging plate 96. In order for plate 96 to engage the carpet sample without slippage, the lower or engaging surface of plate 96 is covered with pad 97 of a friction material such as foam rubber, for example. Robot member 94 is operated in the Z-axis, that is, up and down, by means of a pneumatic piston and cylinder arrangement, as best seen in FIG. 4, and in the Y-axis by pneumatic means 86 moving member 79.

Mounted on member 79 is the drive means for moving robot member 94 in the X-axis direction. At the upstream end of member 79 are mounted a pair of spaced bracket arms 98 and 99 which rotatably support a grooved idler wheel 101 between them. At the downstream end of member 79 a second pair of spaced bracket arms 102, 103, rotatably support a grooved idler wheel 104 between them. Located on the top of member 79 approximately midway between the ends thereof is a pair of spaced, journaled stanchions 106, 107 which rotatably support a shaft 108 which carries a first grooved wheel 109 located between stanchions 106 and 107 and a second grooved wheel 111 located on one end of shaft 108. A drive motor 112 is mounted on member 79 adjacent stanchions 106 and 107 and has mounted on the end of its drive shaft a grooved wheel 113. An endless drive belt 114 extends around wheels 111 and 113 whereby rotation of the motor shaft produces rotation of wheel 111 and, consequently, wheel 109. On one side of stanchions 106 and 107 is a pair of journaled members 116 and 117 which rotatably support between them a grooved idler wheel 119 which extends into a slot 121 in the top of member 79. In like manner, a second pair of journaled members 122, 123, only one of which is visible in FIG. 1, rotatably support between them a grooved idler wheel 124 which extends through a slot 126 in the top of member 79. A belt 127 is affixed to robot member 94 and extends around wheel 101, inside member 79 to idler wheel 119 against which it bears as it passes up through slot 121 and around wheel 109, down through slot 126 as it bears against wheel 124, through member 79 to wheel 104, around wheel 104 and back to robot member 94. When motor 112 rotates wheel 113, belt 114 causes wheel 111 to rotate, thereby rotating wheel 109 and causing belt 127 to move robot member 94 along the X-axis direction. As will be more apparent hereinafter, motor 112 and hence the movement of robot member 94 is under the control of control module 43.

Extending along one side of work table 13 is a fence 128 and along the top edge of a portion thereof extends a restraining plate 129. Fence 128 is positioned to have the edge of the carpet sample bear against it, and restraining plate 129 prevents or minimizes buckling of the sample as the robot member 94 presses it against fence 128. As will be more apparent hereinafter, robot member 94 forces the edge of the carpet sample firmly against the fence as it moves the sample in the X-axis direction so that the backing edge and the pile edge of the sample are substantially coincident. A "sample against fence" detector 130 signals control module 43 when the sample is firmly pressed against fence 128 so module 43 can halt movement in the Y-axis direction. Alternately, detector 130 can be eliminated and robot member 94 can be allowed to apply constant, uniform pressure upon the carpet sample in the Y-axis direction against fence 128, as it also moves the sample in the X-axis direction.

Located at the side of the bed or work table 13 downstream of the hopper assembly 17 is a sewing machine table 131 upon the top surface 132 of which is positioned a sewing machine 133, the needle 134 of which extends through an opening 136 in plate 129 in order to access the edge of the carpet sample. Machine 133 may be any of a number of sewing machines capable of stitching carpet samples. Immediately downstream of needle 134 is a splined wheel 137 which extends through an opening in fence 128 and plate 129. Wheel 137 is supported in a bracket 138 and is driven by a suitable drive means 139, and functions to pull the carpet edge past the needle 134 at a uniform rate and to hold it down firmly against the table surface 13, thereby insuring uniformity of stitching. A tape supply reel 141, rotatably mounted on table surface 132, supplies edging tape 142 through a slot in fence 128 and through a tape folder, not shown, which may be any one of a number of known tape folders, to the edge of the carpet sample. The slot in fence 128 is immediately upstream of needle 134, hence the tape is immediately stitched after folding to the carpet sample. A spool 143 of thread is rotatably mounted on surface 132 and supplies thread to needle 134 as shown. Where the sewing machine 133 has a double stitch mode, a second thread supply may also be mounted on surface 132.

Downstream of the sewing machine 133 is a scissor cutting blade 144 which is pneumatically actuated to cut the trailing edge of the tape 142 after the last edge of the sample has been finished. Blade 144, under control of control module 43, is made to swing down through a slot in fence 128 to cut the tape. Other means for cutting the tape might readily be used, blade 144 being shown simply as one means of doing so.

Fence 128 ends immediately past cutting blade 144, and immediately downstream of its end is a movable fence 146, which, as shown, forms a collinear extension of fence 128. Fence 146 is a part of a sample rotating mechanism which comprises a gripper pad 147 which, as will be discussed more fully hereinafter, is adapted to be actuated by pneumatic means 148 and to swivel down so that its bottom surface bears against the carpet sample. For insuring slip-free purchase against the top of the sample, the bottom surface of pad 147 preferably is covered with a slip-proof member 149 of foam rubber or the like. The entire assembly of fence 146, pad 147 and actuator 148 is adapted to be moved through an arcuate slot 151 by means of a pneumatic piston and cylinder mounted below the table, hence not visible in FIG. 1. The piston and cylinder, which operate under control of control module 43, rotate the pad assembly, and hence the carpet sample against which the pad bears, through an angle of ninety degrees to present the start of a new edge to the sewing machine.

As shown in FIG. 1, a control panel 152 is provided for allowing the operator to start and stop the process, or to institute manual operation of a portion or all of the process. Control panel 152 may also include means for varying the speed of operation of the entire machine, or only certain segments thereof.

Figure 2:
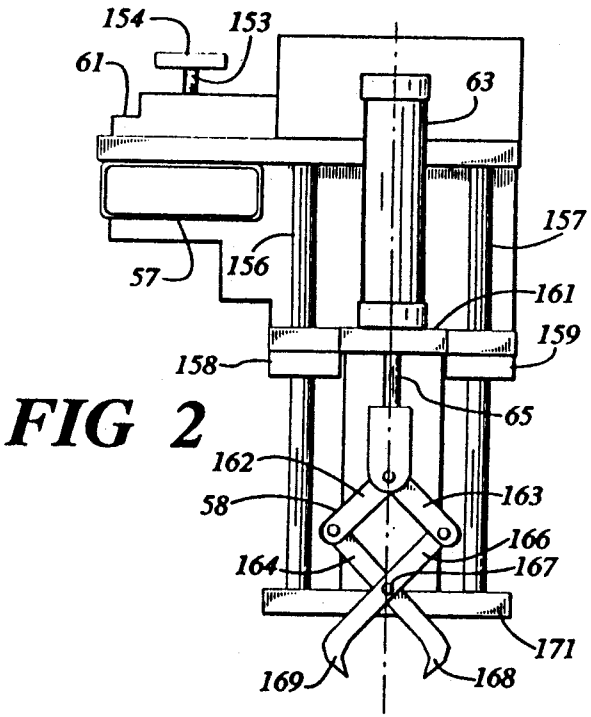
FIG. 2 is an elevation view of the details of the sample gripping and lifting mechanism.

FIG. 2 depicts in greater detail the gripper assembly 58 of FIG. 1 in one embodiment thereof. Mounting member 61 is mounted on arm 57 and held in place by a set screw 153 having a knurled head 154 for permitting adjustment of the lateral (Y-axis) positioning of gripper assembly 58. Mounted on member 171 by means of journaled brackets 158 and 159 are first and second guide rods 156 and 157. Also mounted on a bracket 161 on member 61 is pneumatic cylinder 63 and a piston rod 65. Swivelly mounted to the end of rod 65 are first and second pantagraph arms 162 and 163, at the distal ends of which are swivelly mounted gripper arms 164 and 166, which cross each other and are pivotally joined at a first pivot 167. The distal ends 168 and 169 of arms 164 and 166 are shaped in the form of pointed claws, as shown. Guide rods 156 and 157 terminate in a cross member 171 which holds pivot 167, and which can be adjusted up or down to position the claws 168 and 169 properly for gripping a carpet sample. When rod 65 is lowered, claws 168 and 169 open up, and when rod 65 is drawn into cylinder 63, they close, thereby gripping the carpet.

Figure 3:
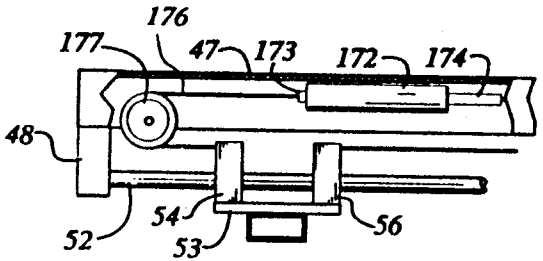
FIG. 3 is a partial cutaway elevation view of a drive mechanism for the lifting mechanism of FIG. 2.

FIG. 3 is a partial cutaway view of an arrangement for moving carrier member 53, and hence arm 57 and grippers 58 and 59 in the X-axis direction along the rods 51 and 52. Within hollow member 47 is mounted a double acting pneumatic cylinder 172 and piston rods 173 and 174. Attached to the side of rods 173 and 174 is a cable 176 which passes over an idler 177 rotatably mounted on member 47, and is affixed to carrier member 53. The portion of the cable attached to rod 174 also passes over an idler wheel, not shown, at the other end of member 47 and is attached to member 53. When cylinder 172 and rods 173 and 174 are actuated under control of control module 43, the carrier member 53 is made to move in the +X or −X direction. It is to be understood that the arrangement of FIG. 3 represents, by way of example, one assembly for moving carrier member 53, and that other arrangements may occur to workers in the art while remaining within the scope of the present invention.

In FIG. 4 there is shown a cutaway view of the robot member 94, which comprises an upper plate 95 and lower, engaging plate 96, having an engaging pad 97 on its lower surface. Mounted on plate 96 is a first hollow shaft 178, and mounted on upper plate 95 is a second, smaller hollow shaft 179 adapted to fit slidably within shaft 178 and telescope relative thereto. Within the two shafts 178 and 179 is a pneumatic cylinder 181 affixed at one end to the underside of plate 95, and a piston and rod 182, the end of which is affixed to the upper surface of plate 96. Under control of control module 43, cylinder 181 and piston 182 raise and lower plate 96 in the Z-axis direction. An accordion pleated protective cover extends between plates 95 and 96 to protect the lifting mechanism. The mechanism for lifting and lowering plate 96 shown in FIG. 4 is one example of a number of possible arrangements for producing movement of engaging plate 96 in the Z-axis direction.

Figure 5:
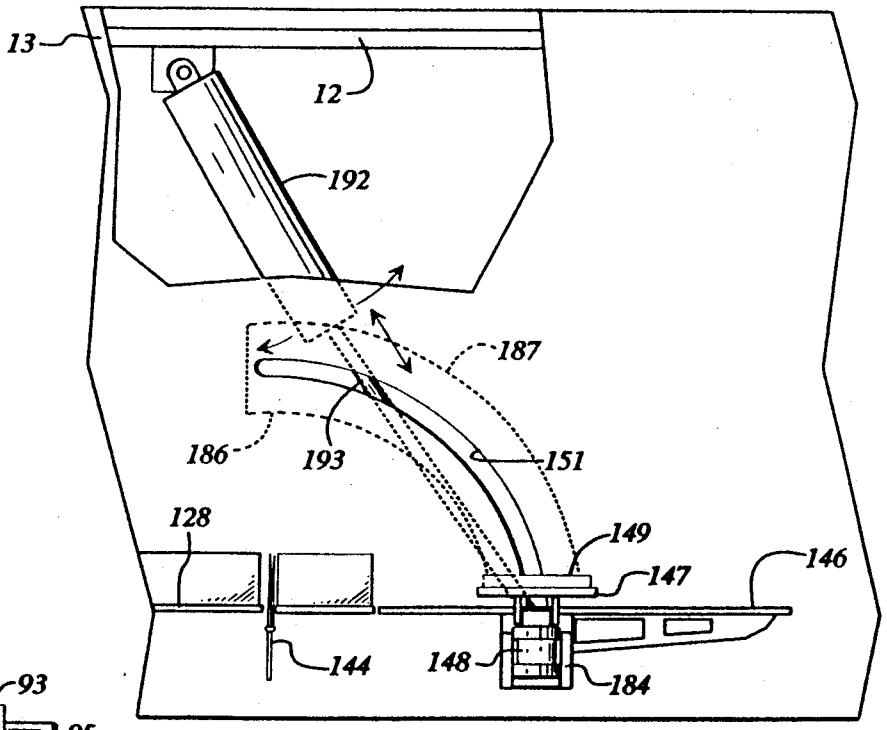
FIG. 5 is a partial cutaway plan view of the sample rotating mechanism.
Figure 5A:
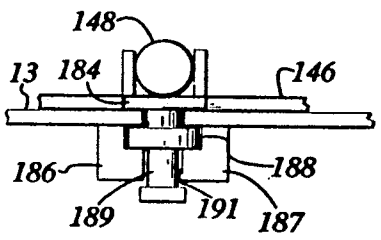
FIG. 5A is an elevation view of a portion of the mechanism of FIG. 5; and, FIG. 6 is a plan view of the work bed of the apparatus of FIG. 1, depicting a preferred placement of certain of the detectors used in the operation of the apparatus.

FIGS. 5 and 5A are partial plan and elevation view respectively of the mechanism for moving the sample rotating assembly, which comprises gripper pad 147, actuating cylinder 148 and fence 146, along arcuate slot 151. As best seen in FIG. 5A, first and second L-shaped members 186 and 187 of suitable bearing material, such as Delrin, extend along the sides of slot 151 and form a track for a traveler or dog 188. Traveler 188 is mounted to the underside of a mounting plate 184 upon which is mounted gripper actuating cylinder 148. Fence 146 is joined to place 184 and moves therewith. A connecting rod 189 extends from traveler 188 through the slot 191 formed by the inner ends of L-shaped members 186 and 187. Swivelly mounted to frame 12 is a pneumatic cylinder 192 which can move as indicated by the curved arrows. Extending from cylinder 192 is a piston rod 193, the distal end of which is swivelly connected to the lower end of connecting rod 189, as shown in FIG. 5A. When rod 193 is retracted into cylinder 192 under control of control module 43, the elements 146, 147, 148, 184, and 188 are pulled along the Delrin track and swung through an angle of ninety degrees, thereby rotating the carpet sample ninety degrees. In practice, the arrangement of FIGS. 5 and 5A have given trouble free, dependable operation. It is to be understood, however, that it would be possible to use other sample rotating arrangements, that being shown here being a preferred mechanism for accomplishing sample rotation.

Figure 6:
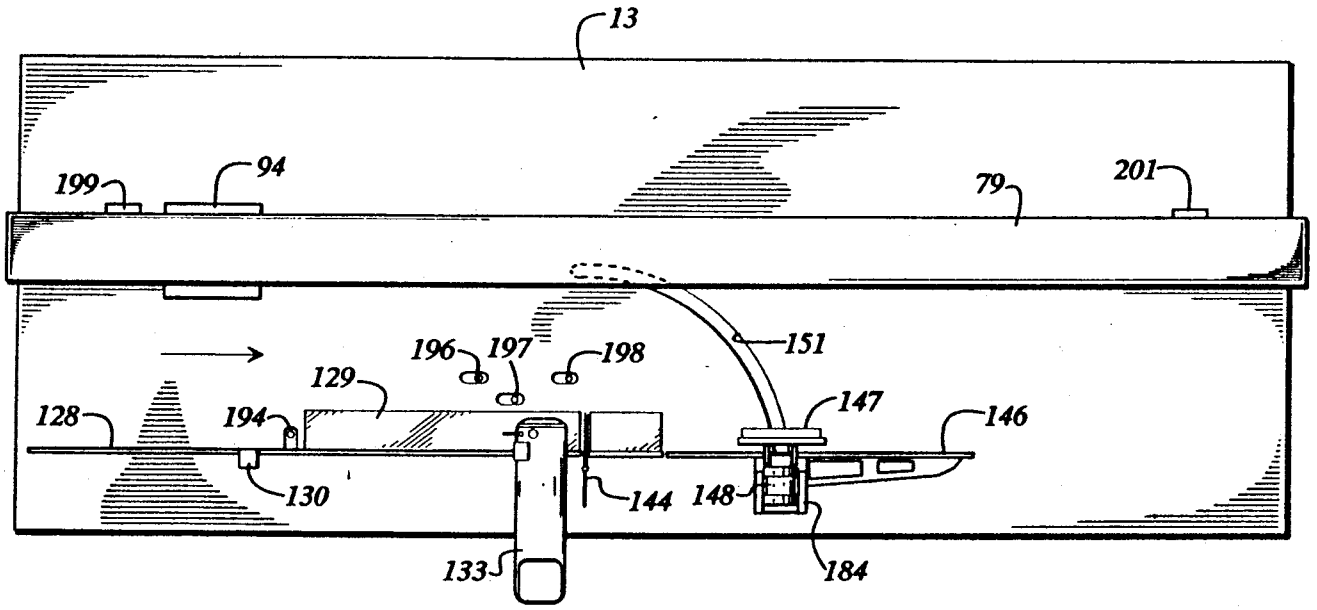

As has been discussed in the foregoing, there are a large number of sensor elements and limit switches for signalling the control module to issue commands to the various components of the system. In FIG. 6, which is a plan view of the apparatus of FIG. 1 depicting certain of the elements of the system, the location of the various sensors are shown. As was pointed out hereinbefore, sensor 130 indicates to the control module 43 when the carpet sample is against the fence 128. Located in the bed of the machine is a first photoelectric proximity sensor 194 which indicates when the carpet sample rotation has been completed, and for the sewing machine to resume stitching. Downstream of sensor 194 is a photoelectric proximity sensor 196 which signals the control module that the trailing edge of the sample has passed and to slow down the movement of member 94, as well as the sewing machine 133. Downstream of sensor 196 is a photoelectric proximity sensor 197, which responds to passage of the trailing edge of the sample to signal module 43 to stop the X-axis movement, lift member 94, and activate the sample rotating mechanism. Downstream of sensor 197 is a photoelectric proximity sensor 198 which senses the leading edge of the sample for trimming any leading tail of binder that may be present with blade 144, and which also senses the trailing edge of the sample for trimming or cutting any trailing tail of binder. Sensors 194 through 198 are preferably of a fibre-optic type mounted in elongated slots, as shown. The slots enable the sensor positions to be fine tuned, and also afford some adjustment for different sewing machine speeds.

Mounted on member 79 are first and second sensors 199 and 201, which may be, for example, magnetically activated, and which define the limits of travel in the X-axis of member 94.

In addition to the foregoing, each of the moving parts may have limit switches or sensors defining the limits of movement. Thus the sample rotating assembly may have a limit switch for stopping its return to the non-rotating position at the proper location. Hopper platform 18 may have a lower limit switch for stopping its downward travel, and a hopper empty detector, which may be, for example, detector 20, and the X-axis movement of carriage 53 may be controlled by limit switches or detectors. It is to be understood that all such detectors and switches are within the purview of the present invention.

As pointed out in the foregoing, the numerous electrical connections, the pneumatic connections, and the compressed air supply have not been shown in order to preserve a degree of clarity in the drawings. Such connections are simple and straightforward and are easily within the skill of workers in the art.

OPERATION

The sequence of operation of the apparatus of FIGS. 1 through 6 is as follows.

The operator first switches the system to "MANUAL" by means of control panel 152, and then drives the hopper platform 18 down to its lower limit by means of an UP/DOWN switch on control panel 152, after which he loads the samples on the hopper platform. After the samples are loaded, the system is switched to AUTOMATIC at the panel 152 and platform 18 indexes up until sample level sensor 20 indicates the top most sample is in position, and carrier member 52 is moved to a position over the sample. The grippers 58 and 59 grip the first sample, lift it up (Z-axis) and move it onto the table as member 53 is moved downstream along the X-axis, and then release the sample.

Upon release of the sample, programmed module 43 moves robot 94 in the upstream (-X-axis) direction until its movement is halted in a "home" position by detector 199. Upon the delivery of the next workpiece or sample by the hopper, robot 94 moves further upstream (-X-axis) one-half of the length of the sample, so as to be approximately centered over the sample. This movement may be halted at the proper position by sensor or detector 199. The plate 96 of robot 94 then moves down (-Z-axis) to engage the sample, and then slides the sample laterally (+Y-axis) until its edge bears against fence 128, as signalled by sensor 130. Y-axis movement ceases and robot 94 is moved along the bed 13 of the apparatus (+X-axis), with restraining plate 129 preventing or minimizing buckling of the sample. Any one of the sensors 194 through 197 can signal the module 43 to start the sewing machine 133, but preferably sensor 197, which is closest to the sewing machine, functions as the starter. On the other hand, a separate sensor strategically located, might be used. As the trailing edge of the sample passes sensor 196, the movement of member 94 is slowed as is the speed of the sewing machine, in preparation for rotation of the sample. When the trailing edge of the sample passes sensor 197, the robot 94 is raised (+Z-axis) out of engagement with the sample and is moved in the -X-axis direction to wait until rotation is complete, rotation clamp 147 is actuated to engage the sample, the speed of the sewing machine 133 is reduced or it is stopped altogether, splined wheel 134 disengages, and the rotation mechanism is moved along slot 151 whereby the sample is rotated ninety degrees. After rotation, the robot 94 is moved down into engagement with the sample, the rotation mechanism returns to its rest position, wheel 134 engages the sample, and the sewing machine is increased to the normal stitching speed. The same steps are repeated until all four edges of the sample have been finished. After the last edge is completed, the robot continues to move the sample until the trailing edge passes over sensor 198, at which time cutting blade 144 is actuated to cut the trailing tape, while the sewing machine 133 is stopped. The robot 94 continues to move the sample in the +X direction until it drops into a collection hopper, for example, positioned at the downstream end of table 13.

As the edge finishing process is going on, hopper 17 raises support member 18 until the next sample is in position, as indicated by sensor 20, for the grippers 58 and 59 to grip it and lift it onto the table. When robot 94 releases the finished sample, it is moved in the −X direction to its home position to engage the next sample which has been placed in position on the table while the preceding workpiece is being sewn.

The foregoing described operation is a preferred method of finishing the carpet sample edges with the apparatus of FIGS. 1 through 6, which, in turn, is a preferred illustrative embodiment of the invention. In practice it has been found that the apparatus and process produce excellent finished edges to carpet samples in an expeditious manner and with a minimum of operator involvement.

Numerous changes to either the apparatus or the process may occur to workers in the art without departure from the spirit and scope of the invention.

We claim:

1. An edge finishing apparatus for finishing the edges of a workpiece, said workpiece having a plurality of edges and having a backing member with discrete edges and a piled upper surface having edges and overlaying the backing member, said apparatus comprising:

a work table having a surface extending longitudinally between first and second ends and transversely between first and second sides, wherein said second end is downstream from said first end, a workpiece storage member adjacent the first end of said work table, means for lifting a workpiece from said storage member and placing it on said work table, aligning means adjacent said first side of said table and extending longitudinally thereof for causing, a first edge of the backing member and the edge of the piled upper surface overlaying the backing member to coincide, a robot member for engaging the workpiece and moving it laterally to cause the first edge of the backing member and the corresponding edge of the piled surface to bear against said aligning means, means including said robot member for moving the workpiece in the longitudinal downstream direction toward said second end of said work table, with the workpiece having a leading edge and a trailing edge, means for applying edge finishing tape to the coinciding edges of the workpiece, sewing means for stitching the edge finishing tape to the coinciding edges of the workpiece, pulling means adjacent said sewing means and downstream thereof for pulling the workpiece past said sewing means to produce a uniformity of stitching, turning means mounted adjacent to said work surface responsive to the passage of the trailing edge of the workpiece past a predetermined point on said work surface for rotating the workpiece, and means downstream of said pulling means and upstream of said turning means for removing excess edge finishing tape.

2. An edge finishing apparatus as claimed in claim 1 wherein said workpiece storage member comprises means for elevating the workpiece to an operative position where it can be lifted from said storage member by said means for lifting.

3. An edge finishing apparatus as claimed in claim 2 and further including sensor means for detecting when the workpiece is in said operative position.

4. An edge finishing apparatus as claimed in claim 3 wherein said storage member comprises a workpiece support member, and said means for elevating the workpiece comprises means for raising said support member.

5. An edge finishing apparatus as claimed in claim 4 and further comprising control means for activating and deactivating said means for raising in response to signals from said sensor means.

6. An edge finishing apparatus as claimed in claim 1 wherein said means for lifting a workpiece from said storage member comprises at least one grasping member for grasping the piled upper surface of the workpiece.

7. An edge finishing apparatus as claimed in claim 6 and further comprising a second grasping member spaced laterally from said first grasping member, and means for activating said grasping members to grasp the workpiece at spaced points on the piled upper surface.

8. An edge finishing apparatus as claimed in claim 7 and further comprising means for moving said grasping members downstream of said storage member whereby the workpiece is moved onto said work table.

9. An edge finishing apparatus as claimed in claim 1 and further comprising first means for moving said robot member laterally and second means for moving said robot member longitudinally.

10. An edge finishing apparatus as claimed in claim 9 wherein said robot member comprises means for moving said robot member into and out of engagement with the workpiece.

11. An edge finishing apparatus as claimed in claim 9 wherein said robot member is mounted on a robot assembly, and said first means for moving said robot member laterally comprises means for moving said robot assembly laterally.

12. An edge finishing apparatus as claimed in claim 9 wherein said robot member is mounted on a robot assembly, said assembly comprising an elongated guide means extending longitudinally, said robot member being movably mounted on said guide means and said second means comprises means for moving said robot member along said guide means.

13. An edge finishing apparatus as claimed in claim 12 wherein said guide means has upstream and downstream ends and further comprising detecting means for detecting the presence of said robot member adjacent said upstream end and detecting means for detecting the presence of said robot member adjacent the downstream end.

14. An edge finishing apparatus as claimed in claim 1 and further comprising detector means for detecting when the edge of the backing member and the edge of the piled upper surface are coincident against said aligning means.

15. An edge finishing apparatus as claimed in claim 14 and further comprising control means for halting the lateral movement of the workpiece in response to signals from said detector means.

16. A carpet sample edging apparatus wherein the samples have a backing member and a piled fabric surface on the backing member, and both the backing member and the piled fabric surface have a plurality of corresponding edges including leading and trailing edges, said apparatus comprising:

a frame member, means defining a work table mounted on said frame member, said work table ,having first and second ends longitudinally spaced from each other in a plane parallel to an X-axis, said second end being downstream of said first end, and first and second sides laterally spaced from each other in said plane parallel to a Y-axis, a storage hopper assembly adjacent said first end of said work table, said storage hopper assembly having a movable platform for supporting a stack of carpet samples, means for moving said platform vertically in a Z-axis direction from a loading position to an operative position wherein the topmost sample of the stack of carpet samples is adjacent said first end of said work table, means on said hopper assembly for lifting the topmost sample from the stack and moving it in the X-axis direction onto said work table, a robot assembly positioned over said work table and spaced therefrom extending longitudinally along a portion of the length of said work table, said robot assembly including a robot member adapted to engage the carpet sample on said work table, moving means for moving said robot member in an upstream direction parallel to said X-axis, control means for controlling said moving means, edge aligning means extending longitudinally adjacent said first side of said work table for causing corresponding edges of the sample backing member and the piled fabric surface to coincide, means for moving said robot member into engagement with the carpet sample on said work table, said means including means for pressing the corresponding edges of the sample against said edge aligning means to force the corresponding backing and piled surface edges into coincidence, first sensor means for detecting the position of the coincident edges against the edge aligning means and signalling said control means to cause said robot member and the sample to move in the downstream direction parallel to the X-axis, tape applying means for applying edge finishing tape to the coincident edges of the sample positioned adjacent said aligning means downstream of said first sensor means, sewing means for stitching the edge finishing tape to the coincident edges of the sample positioned downstream of said tape applying means, second sensor means positioned downstream of said first sensor means and upstream of said tape applying means for detecting passage of the leading edge of the sample and signalling said control means to actuate said sewing means, rotating means controlled by said control means positioned downstream of said sewing means for rotating the carpet sample to present another edge to said tape applying means and said sewing means, third sensor means for detecting passage of the trailing edge of the carpet sample and signalling said control means to cause said rotating means to rotate the carpet sample, and cutting means for removing excess tape from the carpet sample upon completion of the trimming of an edge of the carpet sample.

17. A carpet edging apparatus as claimed in claim 16 and further comprising pulling means positioned adjacent said sewing means for pulling the carpet through the sewing means.

18. A carpet edging apparatus as claimed in claim 17 wherein said pulling means comprises a splined wheel adapted to bear against the edges of the carpet assembly.

19. A carpet edging apparatus as claimed in claim 18 and further comprising means for rotating said splined wheel to cause it to pull the carpet sample.

20. A carpet edging apparatus as claimed in claim 16 wherein said cutting means comprises a scissor cutting blade adapted to be actuated by said control means.

21. A carpet edging apparatus as claimed in claim 16 wherein said work table has an arcuate slot therein extend from said first side, and said rotating means comprises a gripper pad adapted to engage the piled fabric surface of the carpet sample and move along said arcuate slot thereby to rotate the carpet sample.

22. A carpet edging apparatus as claimed in claim 21 and further comprising means for moving said gripper pad into engagement with the piled fabric surface of the carpet sample.

23. A carpet edging apparatus as claimed in claim 21 an comprising means for moving said gripper pad along said arcuate slot.

* * * * *